United States Patent [19]

Ramsey

[11] 4,022,086

[45] May 10, 1977

[54] ADJUSTABLE SOCKET WRENCH

[76] Inventor: Merlin G. Ramsey, 25441 104th Apt. 10A, Kent, Wash. 98031

[22] Filed: Mar. 24, 1976

[21] Appl. No.: 669,894

[52] U.S. Cl. ..... 81/116

[51] Int. Cl.[2] ..... B25B 13/32

[58] Field of Search ..... 81/112, 116; 279/36, 279/42

[56] References Cited

UNITED STATES PATENTS

| | | | |
|---|---|---|---|
| 1,432,324 | 10/1922 | Fannen | 81/116 |
| 2,416,228 | 2/1947 | Sheppard | 81/116 UX |

*Primary Examiner*—Al Lawrence Smith
*Assistant Examiner*—James G. Smith
*Attorney, Agent, or Firm*—Graybeal, Barnard & Uhlir

[57] ABSTRACT

A longitudinally split socket member is connected to an end of an elongated drive shank having throughout a part of its length a generally square cross-section and threaded corners. An adjustment cone is threadably received on said threads and when rotated travels along said shank and axially into or out from a longitudinally split conical socket formed in lever portions of the socket member halves. Axial movement of said cone adjusts the spread of the lever portions of the socket member. This results in pivotal movement of the two socket member halves about a transverse pivotal axis and also results in a corresponding change in the spread of wrench jaws which extend endwise of the socket member from the pivotal axis, oppositely from the lever portions. A drive member is movable axially along the drive shaft and carries a plurality of drive keys which extend from said drive member axially into key sockets formed therefor in the lever portions of the socket member halves. These key sockets are dimensioned to snugly receive the keys in the direction extending axially of the pivotal axis and to loosely receive said drive keys in the direction extending prependicularly to said pivotal axis, so that the drive keys can mate with the key sockets throughout the full range of adjustment of the socket wrench member.

4 Claims, 10 Drawing Figures

ADJUSTABLE SOCKET WRENCH

BACKGROUND OF THE INVENTION

1. Field of the Invention

This invention relates to socket wrenches, and more particularly to the provision of a new socket wrench characterized by a socket member which is adjustable to fit several sizes of bolt heads and/or nuts.

2. Description of the Prior Art

A socket wrench is a wrench frequently used in automotive work, or in similar work where it is often necessary to operate in close or in inaccessible places, because a ratchet handle which requires only a very short swing can be used on it. The sockets are normally supplied in sets to fit standard sized nuts or bolt heads and are readily fitted onto or removed from the handle. The nut or bolt head can be completely tightened or loosened without removing the wrench from the work.

The concept of an adjustable wrench, i.e. a wrench made so that its jaws can be opened or closed to fit the flats of the nut or bolt head to be turned, has been known for a very long time. The monkey wrench and the adjustable open-end wrench are common types of adjustable wrenches.

The main object of the present invention is to provide an adjustable ratchet driven socket type wrench.

SUMMARY OF THE INVENTION

The adjustable socket wrench of the present invention makes it possible to construct a relatively small socket wrench set with the same capacity of a quite large set of conventional socket wrenches. Also, it makes it possible to construct a single set of socket wrenches which can accommodate both English and metric dimensioned nuts and bolts, and which can accommodate worn nuts and bolts.

Adjustable socket wrenches according to the present invention are basically characterized by a socket member that is longitudinally divided into two socket member halves. The socket member halves are pivotally connected together at a location intermediate their ends, for pivotal movement about a transverse axis which substantially intersects the rotational axis of the socket member. The socket member halves have complementary wrench jaws which extend lengthwise of said socket member in one direction from said pivot means, and complementary lever portions which extend endwise of said socket member in the opposite direction from said pivot means. The wrench further includes means for adjustably affixing the spread of said lever portions, to in that manner pivotally move the socket member halves and change the spread of the wrench jaws.

An object of the present invention is to provide an adjustable socket wrench member that is longitudinally divided into two halves which are pivotally connected together at a location intermediate the two ends of the socket member by torque carring pivot pin means.

Another object of the present invention is to provide a wrench of the type described which includes means establishing a positive drive between a shank portion of the wrench and the adjustable socket member.

Yet another object of the present invention is to provide an adjustable socket type wrench which, unlike conventional adjustable open-end wrenches (e.g. a Crescent wrench), does not during use subject an adjustment worm to forces tending to rotate such worm and change the size of the wrench.

These and other objects, features and advantages of the invention will be apparent from the following description of a preferred embodiment of the invention.

DESCRIPTION OF THE PREFERRED EMBODIMENTS

Two embodiments of the invention are illustrated which are identical in all respects except for the configuration of the engaging surfaces formed on the inner portions of the wrench jaws.

Referring specifically to FIGS. 1, 2 and 4 – 10, the first embodiment comprises a socket member 10 which is connected to an elongated drive shank 12 which is shown to have a box end 14 for receiving the drive pin of a ratchet wrench (not shown) or the like.

Figure 1:
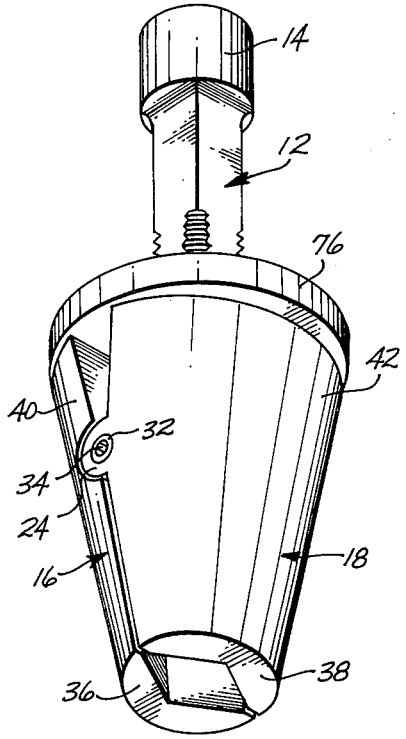
FIG. 1 is an isometric view looking from below and towards the wrench jaw end of one embodiment of adjustable socket wrench constructed according to the present invention, said embodiment including a pair of wrench jaws configured to engage diametrically opposed corner portions of a hexagonal nut or bolt head.
Figure 2:
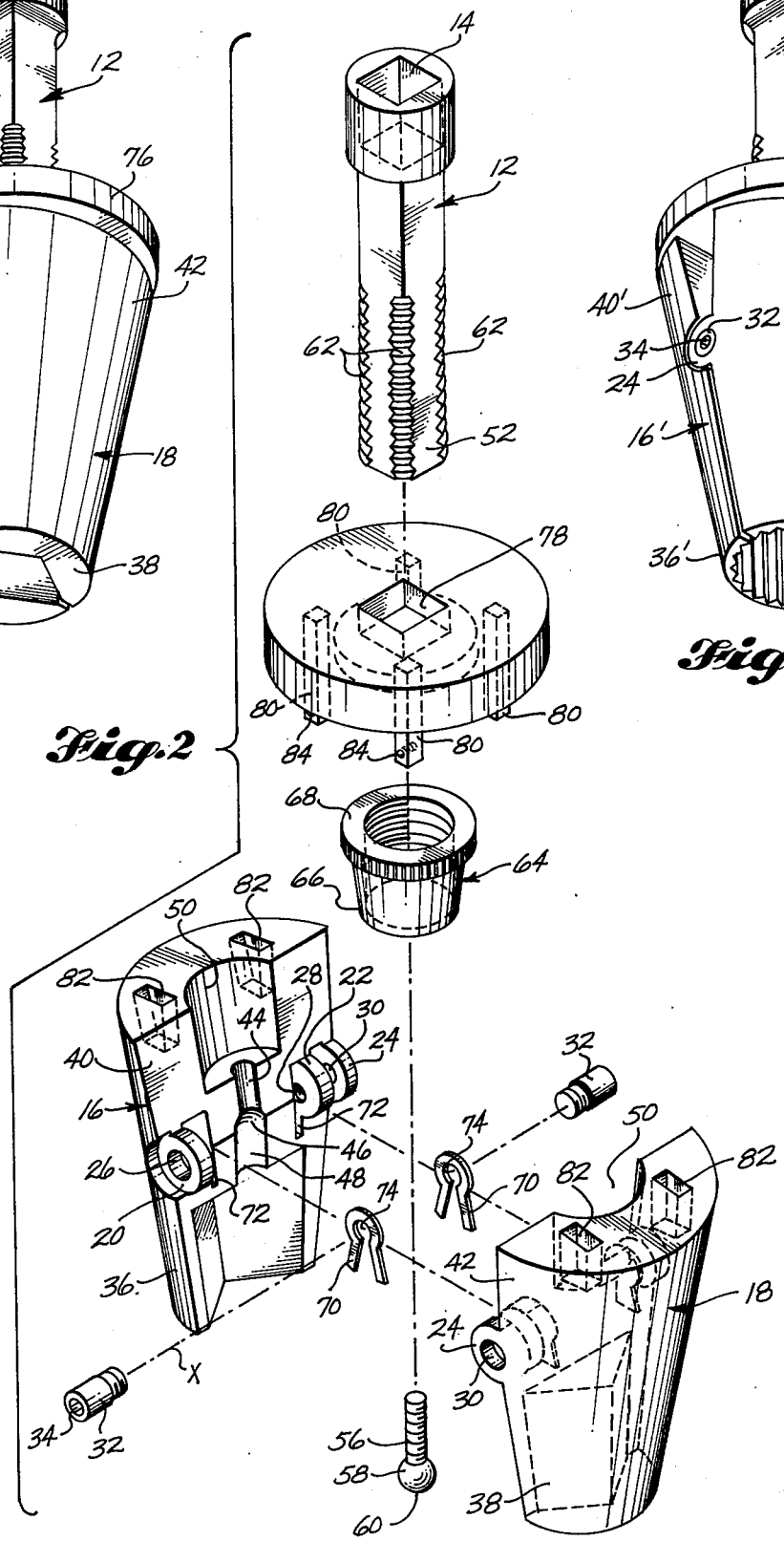
FIG. 2 is an exploded isometric view, taken from above, of the adjustable socket wrench shown by FIG. 1.
Figure 3:
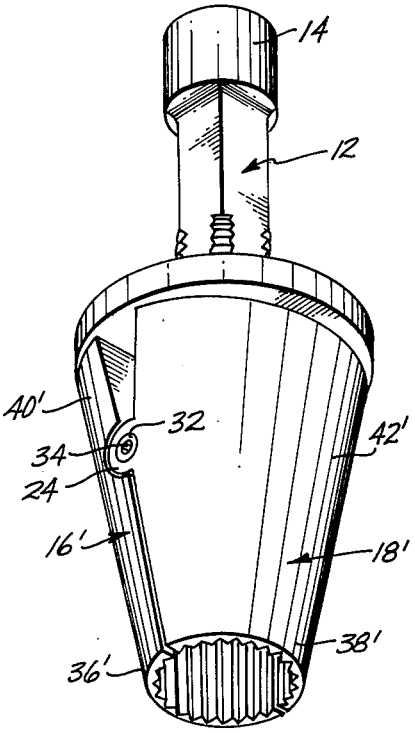
FIG. 3 is a view like FIG. 1, but showing a different configuration of the engagement surfaces on the inside of the wrench jaws.
Figure 7:
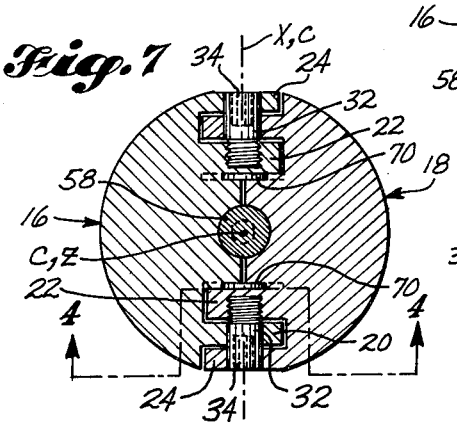
FIG. 7 is a cross-sectional view taken substantially along line 7—7 of FIG. 4, showing the center of a ball-headed nut, which secures the socket member to the drive shaft, lying on both the rotational axis of the socket member and the transverse pivotal axis of the socket member halves, where such axes intersect each other.
Figure 8:
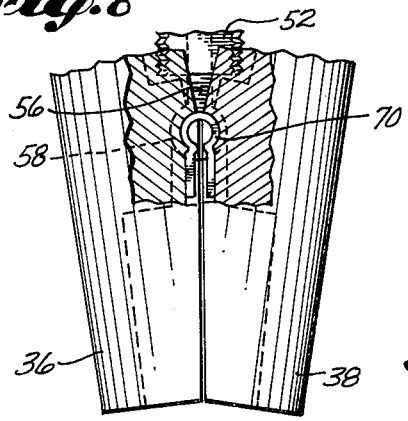
FIG. 8 is a fragmentary view of the jaw portions of the wrench member with foreground portions cut away to show hairpin type springs which may be used for biasing the socket member halves towards a fully open position.

The socket member 10 is longitudinally divided into two parts 16, 18, hereinafter termed socket member halves. As best shown by FIG. 2, socket member halves 16, 18 may be identical in construction. Each socket member half is constructed to include three pivot pin supporting ears 20, 22, 24, including axially aligned pin receiving openings 26, 28, 30. Each ear 20 is constructed to be received between the ears 22, 24 of the other socket member half (FIG. 7). By way of typical and therefore nonlimitative construction, the opening 28 in each ear 22 may be threaded to receive the threaded portion of a pivot pin 32. As clearly shown in FIG. 7, in this construction each pivot pin 32 is introduced axially through openings 30, 26 of the ears 24, 20 on its side of the socket member 10 and is then threaded into the internal threads formed in its opening 28. In use, the intermediate portions of the pins 32 act as journals and the ears 20 act as bearings. As shown by FIG. 7, the pivot pins 32 may be constructed to be of such a length that the head portions thereof are substantially flush with the outer surfaces of the ears 24. Hexonagal sockets 34 may be provided in the head portions of pins 32, to receive an end portion of an Allen wrench (not shown), to be used for tightening and loosening the pivot pins 32.

Figure 4:
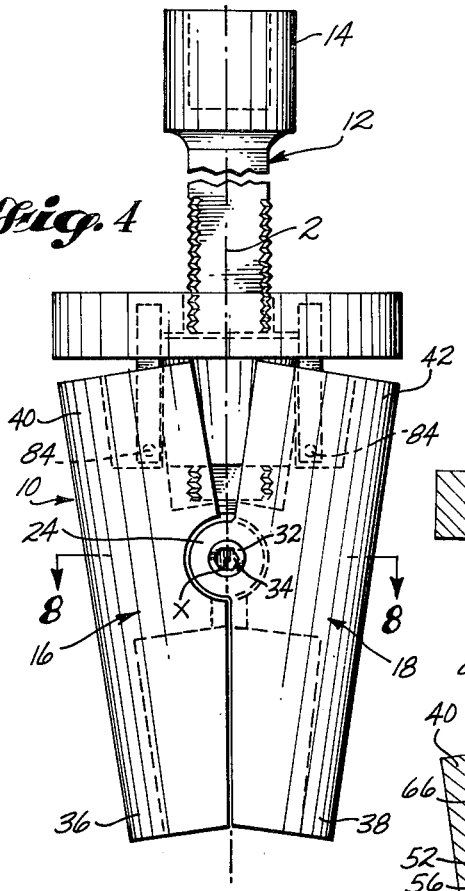
FIG. 4 is a side elevational view of the wrench shown by FIGS. 1 and 2, which has been adjusted down to its smallest size.
Figure 5:
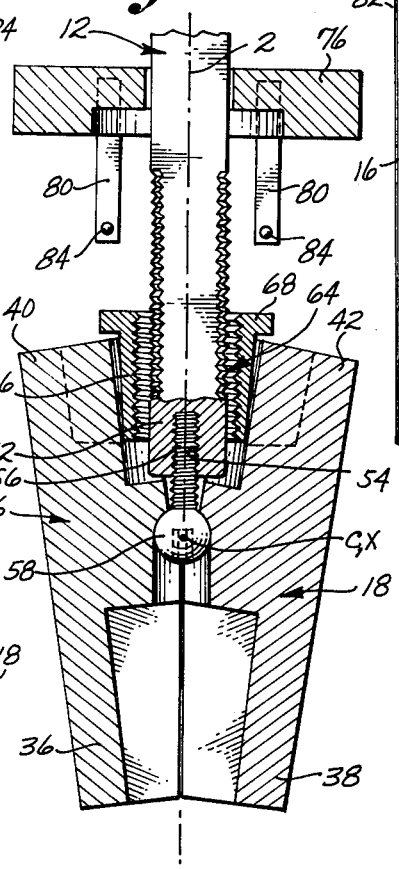
FIG. 5 is a view like FIG. 4, but showing the drive member lifted so as to expose the rotatable adjustment cone.
Figure 6:
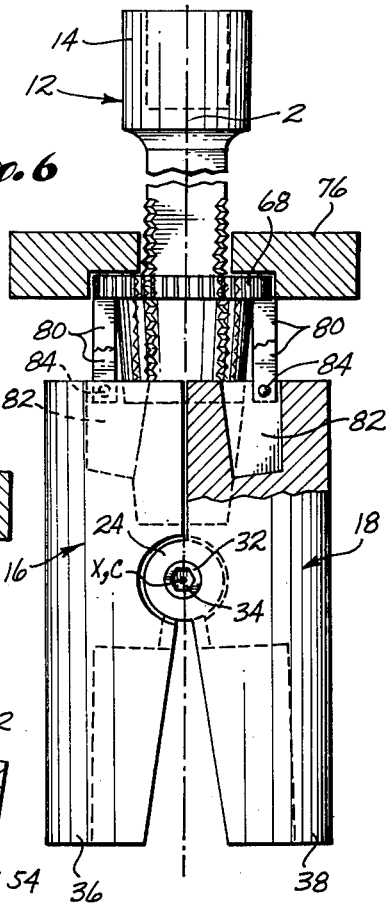
FIG. 6 is a view similar to FIGS. 4 and 5, but showing the wrench in a fully open position.

The pin mounting ears 20, 22, 24, and the pivot pins 32, of the illustrated embodiment together constitute pivot means for connecting the socket member halves 16, 18 together at a location intermediate their ends, for pivotal movement about a transverse axis X (FIG. 7). Pivotal axis X substantially intersects the axis of rotation Z which coincides with the longitudinal axis of drive shank 12 (FIGS. 4 – 6).

Socket member halves 16, 18 include complementary wrench jaws 36, 38 extending endwise thereof in the outboard direction from said pivotal axis X, and complementary lever portions 40, 42 extending endwise thereof in the opposite direction from the pivotal axis X.

According to the invention, the wrench includes means for adjusting the spread of the lever portions 40, 42, to in that manner pivotally move the socket member halves 16, 18 about the axis X and cause an opposite change in the spread of the wrench jaws 36, 38.

In the preferred embodiment, the socket member halves 16, 18 are formed to include complementary half portions 44 of an axial passageway 44, 44 and half portions 46 and 48 of a spherical socket 46, 46 and an axial passageway 48, 48 leading therein. As best shown by FIGS. 2 and 5, passageways 44, 44 and 48, 48 are coaxially aligned with socket 46, 48 and extend therefrom in opposite directions along the axis Z.

In the preferred embodiment, the lever portions 40, 42 are formed to include a pair of complementary socket halves 50 which together define an inwardly tapering socket 50, 50 having a longitudinal axis substantially coinciding with axis Z. The inboard end portion 52 of drive shank 12 is formed to include an internally threaded, axially extending blind passageway 54 (FIG. 5), the longitudinal axis of which coincides with the longitudinal axis of drive shank 12, and also with the axis rotation Z (FIG. 5). A ball headed screw 56 is used for securing the socket member 10 to the drive shank 12. As best shown by FIG. 5, it is inserted through a space defined between the jaws 36, 38 of members 16, 18, then through the passageway 48, 48, then through spherical socket 46, 46, and next through passageway, 40, 44 and into passageway 54. The ball head 58 of member 56 may include a slot 60 for receiving a screw driver. Such screw driver (not shown) is inserted axially through the space formed between jaws 36, 38 and into slot 60. The screw driver is then rotated for in turn rotating screw 46, to cause its threaded portion to enter passageway 54 until the base portion of ball 58 is seated in the spherical socket 46, 46 (FIG. 5). The geometrical center C of the ball 58 substantially coincides with the center of curvature of the split socket 46, 46 and substantially intersects both the pivotal axis X and the axis of rotation Z (FIGS. 2 –7).

As best shown by FIG. 5, the drive shank 12 is substantially smaller in cross section than the conical split socket 50, 50. At least a substantial portion of drive shaft 12 has a non-circular cross sectional shape (e.g. square ), for reasons to be hereinafter discussed, the corner portions of which are threaded. These threaded corner portions 62 threadably engage the internal threads of an adjustment cone 64. Adjustment cone 64 includes a tapered body portion 66 and a grip ring 68. When adjustment cone 68 is rotated in travels axially along the threaded portion of drive shank 12 and also axially within the split conical socket 50, 50.

As best shown by FIG. 5, axial adjustment of adjustment cone 64 within socket 50, 50 adjusts the spread of the lever portions 40, 42 of socket member halves 16, 18. When adjustment cone 64 is advanced downwardly into split socket 50, 50, its body portion 66 displaces the lever portions 40, 42 laterally outwardly from the axis of rotation Z. This causes the socket member halves 16, 18 to rotate in position about the pivotal axis X and the center C. It also causes the wrench jaws 36, 38 to move towards each other. As should be evident when the adjustment cone 64 is backed out from the socket 50, 50, the spread of the lever portions 40, 42 is reduced and the spread of the wrench jaws 36, 38 is increased.

According to an aspect of the invention, a pair of hair pin type springs 70 are provided for biasing the wrench jaws 36, 38 open, and hence the lever portions 40, 42 together. Slots 72 may be cut into the wrench member halves 16, 18 inwardly of the pin ears 22, for receiving half portions of the springs 70. The spring 70 each include an eye 74 at a bight end thereof through which the inner end portion of the pivot pin 32 extends.

In preferred construction, the wrench includes a means for transmitting torque from the drive shaft 12 to the socket member 10 which is operable throughout the full range of adjustment of the wrench member 10. This means comprises a member 76, illustrated in disc form, having a central opening 78 which corresponds in cross sectional configuration to the general cross sectional configuration of the drive shank 12. When the drive shank 12 is within openings 78 the member 76 is non-rotatably attached to drive shaft 12, but is free to be slid axially therealong. Member 76 carries a plurality (e.g. four) of drive keys 80, in spaced relationship with the geometrical center of member 76 which substantially coincides with the axis of rotation Z. The lever portions 40, 42 of socket member halves 16, 18 are formed to include a number of key sockets 82, equal in number to the keys 80. The spacing of the sockets 82, and their general configuration, are such that the keys 80 are snugly received within the sockets 82 in the direction extending parallel to the pivotal axis X. However, the sockets 82 are elongated in the direction perpendicular to pivotal axis X a sufficient enough amount so that the keys 80 will enter into the socket 82 regardless of the state of adjustment of the adjustment cone 64. This is best appreciated by comparing the relative position of the keys 80 within the sockets 82 in FIG. 4 with their positions in FIG. 6. The keys 80 may be provided with detent elements 84 of the type that is usually provided on the square pin portion of a ratchet wrench, so that the keys 80 will be frictionally held within the sockets 82.

Figure 9:
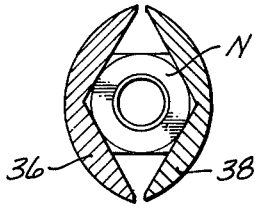
FIG. 9 is a cross-sectional view through the wrench jaws of a wrench adjusted to fit a relatively small bolt head which is itself shown in plan.
Figure 10:
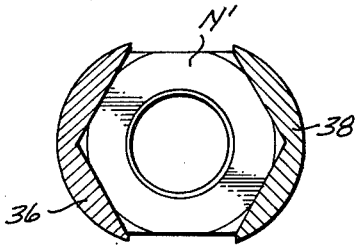
FIG. 10 is a view like FIG. 9, but showing the wrench jaws adjusted to a fully open position and in engagement with a larger bolt head.

FIG. 9 is a sectional view through the outer end portions of the jaws 36, 38 of a wrench adjusted to fit a relatively small nut 40. FIG. 10 is a similar view of the same wrench member, but showing it adjusted to fit a substantially larger nut N'.

As should be evident, the torque transfer member 76 and the drive keys 80, acting together with the pivot pins 32 which are located intermediate the length of the socket member 10, provide a quite positive and reliable mechanism for transferring drive torque from the drive shank 12 to the jaws 36, 38.

The embodiment illustrated by FIGS. 1, 2 and 4 – 10 is characterized by wrench jaws 36, 38 having dihedrally related wrench surfaces spaced 60° apart so that each pair of surfaces can engage one of an opposed corner portions of the nut or bolt head. The embodiment of FIG. 3 differs from the embodiment of FIGS. 1, 2 and 4 – 10 only in that its jaw portions 36', 38' are formed to include a pattern of serrations for gripping corner portions of the nuts or bolt heads.

It is to be recognized that the adjustable socket wrench of this invention may also be used in machinery as a part for engaging and turning another part. For example, the drive shank 12 might be suitably mounted as part of a machine, for rotation about the axis Z, with the jaws 36, 38 (or 36', 38') being used to engage another member, so that it will be rotated together with the wrench. Accordingly, the term "wrench" as used herein, includes a machine element or tool which in use engages another member for transferring rotational torque to it.

What is claimed is:

1. An adjustable socket wrench having an axis of rotation and comprising:

a longitudinally divided socket member comprising two socket member halves, and pivot means connecting said socket member halves together at a location intermediate their ends, for pivotal movement about a transverse axis which substantially intersects the axis of rotation of said socket wrench, said socket member halves having complementary wrench jaws extending endwise of said socket member in one direction from said pivot means, and complementary lever portions extending endwise of said socket member in the opposite direction from said pivot means;

means for adjusting the spread of said lever portions to in that manner pivotally move said socket member halves and change the spread of said wrench jaws;

an elongated drive shank connected to said socket member and projecting axially therefrom endwise of the lever portion end of the socket member, said shank having a non-circular exterior cross section extending throughout at least a portion of its length, a drive member having a complementary non-circular opening therein in which the non-circular portion of said drive shank is snugly but slidably received, whereby said drive member is movable in position axially along said shank, a plurality of drive keys secured to said drive member at locations radially offset from said complementary non-circular opening, said drive keys extending axially from said drive member towards the socket member, and wherein each lever portion of the socket part is formed to include at least one key socket positioned to receive a said drive key, wherein said key sockets are elongated in a direction that extends perpendicular to the transverse pivotal axis of said socket member halves, a distance sufficient to permit the drive keys to be received in said key sockets throughout the full range of adjustment of the socket member, and wherein said key sockets are sized to snugly receive said drive keys in the direction extending axially of the pivotal axis.

2. An adjustable socket wrench according to claim 1, wherein the lever portions of said socket member halves are each formed to include one-half of a split socket which is constructed about the axis of rotation, and wherein said means for adjusting the spread of said lever portions includes a cone member which is snugly receivable within said split socket and which is adjustably affixable in position within said split socket along said axis of rotation.

3. An adjustable socket wrench according to claim 1, wherein said socket member halves are formed to each include one-half of a split spherical socket, the center of which substantially coincides with both the axis of rotation and the transverse pivotal axis, and wherein said drive shank includes an internally threaded axial opening, in the end thereof which is connected to said socket member, and a ball headed bolt for securing said socket member to said drive shank, with said bolt being insertable from the wrench jaw end of the socket member axially through said spherical socket and then threaded into the threaded axial opening in the drive shank, with said spherical socket being sized to snugly receive the ball head of said bolt when said bolt is seated.

4. An adjustable socket wrench according to claim 3, wherein the lever portions of said socket member halves are each formed to include one-half of a split socket which is constructed about the axis of rotation, and wherein said means for adjusting the spread of said lever portions includes a cone member which is snugly receivable within said split socket and which is adjustably affixable in position within said split socket along said axis of rotation.

* * * * *